US005546732A

United States Patent [19]

Coleman et al.

[11] Patent Number: 5,546,732

[45] Date of Patent: Aug. 20, 1996

[54] METHOD AND APPARATUS FOR MAKING AND FILLING BAGS

[75] Inventors: Charles P. Coleman; Dennis D. Garberg; Thomas J. Butler, all of Overland Park, Kans.

[73] Assignee: Dennis Garberg & Associates, Inc., Overland Park, Kans.

[21] Appl. No.: 502,095

[22] Filed: Jul. 13, 1995

[51] Int. Cl.[6] ..... B65B 09/00

[52] U.S. Cl. ..... 53/450; 53/553; 53/238; 53/474

[58] Field of Search ..... 53/570, 284.7, 53/450, 553, 555, 238, 474; 493/204, 210, 216, 223, 224

[56] References Cited

U.S. PATENT DOCUMENTS

| | | | |
|---|---|---|---|
| 1,975,404 | 10/1934 | Prucha . | |
| 2,474,025 | 6/1949 | Aspinall . | |
| 2,917,164 | 12/1959 | Kehr . | |
| 2,964,892 | 12/1960 | Grosjean . | |
| 3,332,324 | 7/1967 | Lehmacher et al. | 493/224 |
| 3,411,419 | 11/1968 | Becker et al. | 493/224 |
| 3,429,718 | 2/1969 | Helms . | |
| 3,456,866 | 7/1969 | Civitello . | |
| 3,762,628 | 10/1973 | Sargent . | |
| 3,789,570 | 2/1974 | Mullins, Jr. . | |
| 3,805,683 | 4/1974 | Hook | 493/204 |
| 3,807,118 | 4/1974 | Pike . | |
| 3,807,122 | 4/1974 | Kihnke et al. . | |
| 3,817,448 | 6/1974 | Schneider . | |
| 3,868,807 | 3/1975 | Noyes et al. . | |
| 3,882,656 | 5/1975 | Lerner . | |
| 3,921,827 | 11/1975 | Joice | 493/204 |
| 3,945,173 | 3/1976 | Buzzi . | |
| 3,998,135 | 12/1976 | Sargent . | |
| 4,172,349 | 10/1979 | Lipes . | |
| 4,201,031 | 5/1980 | Wiles . | |
| 4,256,256 | 3/1981 | Meyers . | |
| 4,268,344 | 5/1981 | Jones . | |
| 4,286,907 | 9/1981 | Houle et al. | 493/204 |
| 4,290,467 | 9/1981 | Schmidt . | |
| 4,291,517 | 9/1981 | Lipes . | |
| 4,341,054 | 7/1982 | Courtheoux . | |
| 4,480,750 | 11/1984 | Dancy . | |
| 4,541,226 | 9/1985 | Nausedas . | |
| 4,543,768 | 10/1985 | Nishikawa et al. . | |
| 4,662,147 | 5/1987 | Scheja . | |
| 4,726,171 | 2/1988 | Kreager et al. . | |
| 4,744,673 | 5/1988 | Nakamura . | |
| 4,805,381 | 2/1989 | Hannon . | |
| 4,830,317 | 5/1989 | Kober et al. . | |
| 4,840,336 | 6/1989 | Stroh et al. . | |
| 4,936,817 | 6/1990 | Runge . | |
| 4,938,608 | 7/1990 | Espinosa . | |
| 4,945,713 | 8/1990 | Widenback . | |
| 4,981,216 | 1/1991 | Wilfong, Jr. . | |
| 4,989,732 | 2/1991 | Smith . | |
| 4,991,980 | 2/1991 | Cohen et al. . | |
| 4,993,845 | 2/1991 | Faltynek . | |
| 4,995,217 | 2/1991 | Francis, Jr. . | |
| 5,020,750 | 6/1991 | Vrooman et al. . | |
| 5,213,145 | 5/1993 | Huang et al. . | |
| 5,228,268 | 7/1993 | Jensen . | |
| 5,249,409 | 10/1993 | Jensen . | |
| 5,290,391 | 3/1994 | Czecm et al. . | |
| 5,363,966 | 11/1994 | Czecm et al. . | |

FOREIGN PATENT DOCUMENTS

| | | |
|---|---|---|
| 2003443A | 3/1979 | Germany . |
| 2066209 | 7/1981 | United Kingdom . |

*Primary Examiner*—John Sipos
*Assistant Examiner*—Gene L. Kim
*Attorney, Agent, or Firm*—Hovey, Williams, Timmons & Collins

[57] ABSTRACT

A packaging system indexes a pouch web, packaging web, and base web for forming a bag with an attached pouch enclosing an article such as literature or a merchandising sample. The preferred apparatus attaches the pouch web to the packaging web to form a pocket that opens adjacent respective edges while the base web remains unattached. An article is dispensed into the pocket with each indexing movement of the webs and the pocket then sealed inboard of the bag section edges to form a pouch enclosing the article. A bag handling mechanism holds and conveys the bags for accumulation into a bundle.

4 Claims, 6 Drawing Sheets romans 4.0

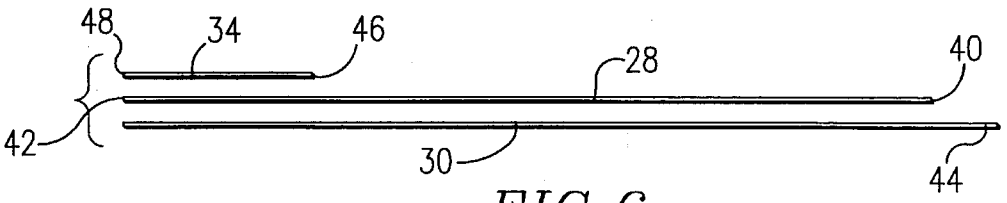
FIG. 6.
FIG. 7.
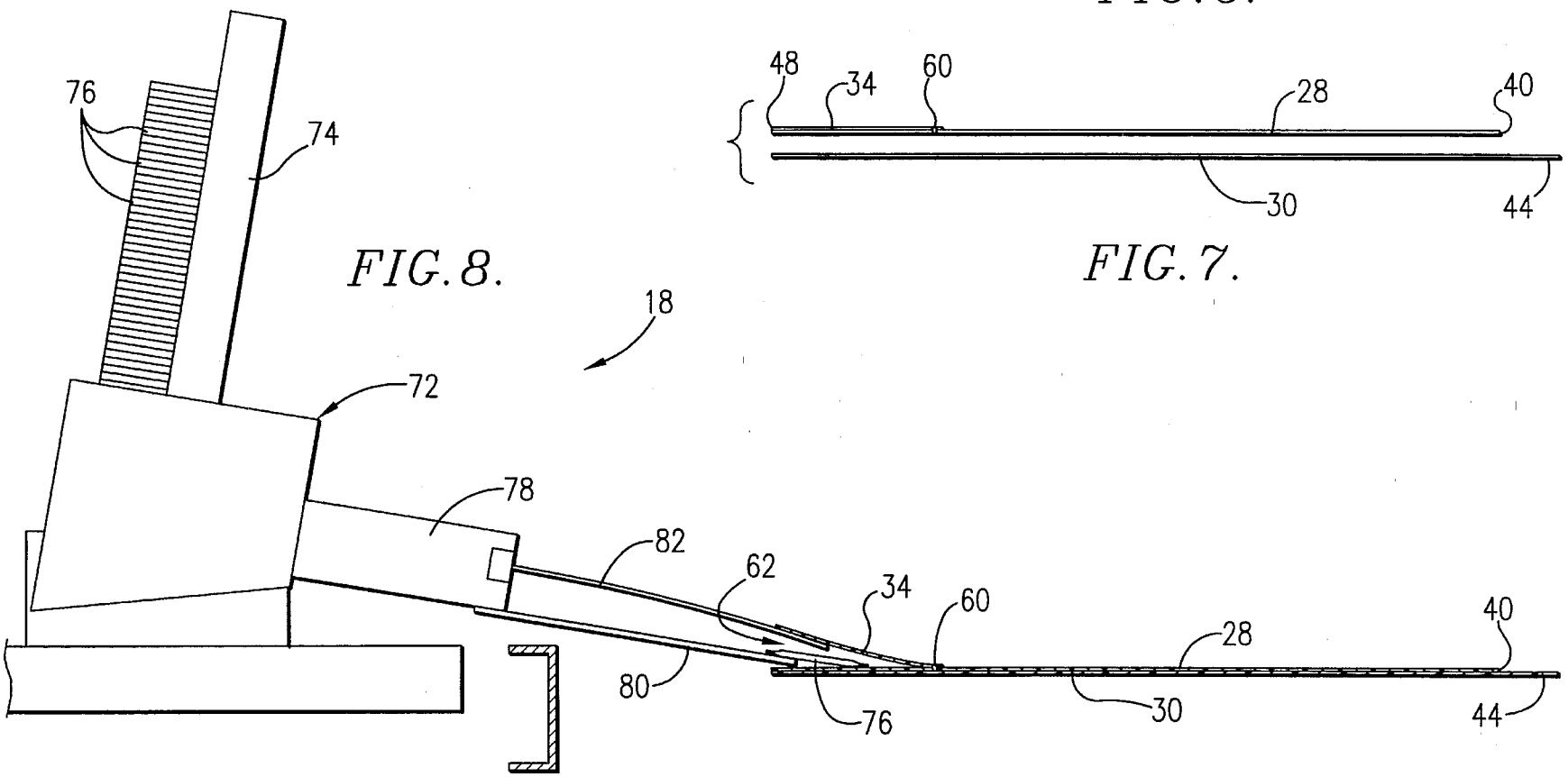
FIG. 8.

METHOD AND APPARATUS FOR MAKING AND FILLING BAGS

BACKGROUND OF THE INVENTION

1. Field of the Invention

The present invention relates to the field of packaging. More particularly, the invention concerns a packaging system that indexes a pouch web, packaging web, and base web for forming a preferably elongated bag with an attached pouch enclosing an article such as a merchandising sample. A bag handling mechanism holds and conveys the bags for accumulation into a bundle.

2. Description of the Prior Art

As a marketing technique, newspapers may be delivered to subscribers in plastic bags configured to include sealed pouches for enclosing articles such as merchandise samples and advertising literature. For efficiency and for the security of the enclosed articles, the articles are sealed in the pouches before the bags are shipped to the newspaper delivery service. The service then inserts the newspapers into the bags for delivery to the subscribers. Such bags and pouches may be used in other delivery schemes, such as enclosing bread or other food items for example.

In U.S. Pat. No. 5,228,268 to Jensen, the bags have been produced using a top web superposed over a bottom web and sealed along one longitudinal edge. The bottom or wide web is then folded to form a bottom edge. The top web is sealed to the folded edge of the bottom strip to form a flap having an opening spaced from the fold. Articles are then inserted through the opening and glued into place at a gluing station. With this technique, top webs of different widths must be carried in inventory to form pockets of different depths for variously sized articles.

A heat sealer then seals the exposed pocket edge to the top web which also seals the top web to the bottom web with the effect of shortening the length of the bag being formed. This requires that the two webs be a sufficient width so that the resulting bag is long enough to hold a newspaper with that portion of the webs below the pocket seal being excess.

In the next stage of the prior art technique, the sides of the bags are sealed and cut. Because of the indexing movement of the webs, an article may shift and interfere with the sealing and cutting. To solve this, the prior art has used adhesive in the pocket to prevent the shifting. In another device shown in U.S. Pat. No. 5,249,409 to Jensen, completed bags are filed by a machine which indexes the bags into position, lifts the topmost bag and billows open the pocket, and then introduces an article into the pouch and seals the pouch closed. The device lifts each bag over and across the securing header from a platform to a support plate. Such a mechanism is complicated and necessitates manufacturing a group of bags prior to inserting the articles in the pouches.

SUMMARY OF THE INVENTION

The present invention solves the prior art problem discussed above and provides a distinct advance in the state of the art. More particularly, the packaging system hereof allows differently sized pouches to be formed without the need to carry differently sized bag-forming webs, prevents an enclosed article from interfering with cutting and sealing operations, and provides an efficient manner for handling completed bags.

The preferred apparatus includes a dispensing station for dispensing separate pouch, package and base webs. A pouch sealer then seals one edge of the pouch web to the top web spaced from the edge of the top web while the base web remains separate. This forms a pocket that opens at the end of a bag section. An article is inserted into the pocket formed at the end of the bag section. A sealing station then seals the pouch web to the top web adjacent the sides of the article and preferably near the side boundaries of the bag section. The end of the bag section is then sealed at the pocket opening. This forms a pouch which encloses the article.

The preferred apparatus also includes a discharge station having rotating vacuum arms with respective holding assemblies attached thereto. Each holding assembly includes a frame for holding the pouch portion of a completed bag including the inserted article and a shiftable holding member that shifts to an open position for receiving the bag and to a closed position for holding the bag during rotation. A weight member is coupled with the holding member, presents a weight moment greater than that of the holding member, and is positioned to shift the holding member between the open and close positions.

In the preferred embodiment of the invention, at least three separate webs are employed to create the final bag. Typically only one of the webs is imprinted, permitting faster web production rates because two printed webs can be printed side by side rather than one wide web on which printing appears only on one side. This usually doubles printing efficiency. If more than one of the three webs are imprinted, different presses may be used for each printing presentation.

BRIEF DESCRIPTION OF THE DRAWINGS

FIG. 6 is a schematic representation of the separate webs used in the apparatus of FIG. 1;

FIG. 7 is a schematic representation of the webs used in the apparatus of FIG. 1 showing the pouch web attached to the printed packaging web;

FIG. 8 is a side elevational view of the article dispenser of the apparatus of FIG. 1 showing the insertion of an article into a pocket between the pouch and packaging webs of FIG. 7 taken along line 8—8 of FIG. 1;

DETAILED DESCRIPTION OF THE PREFERRED EMBODIMENTS

Figures 1, 2:
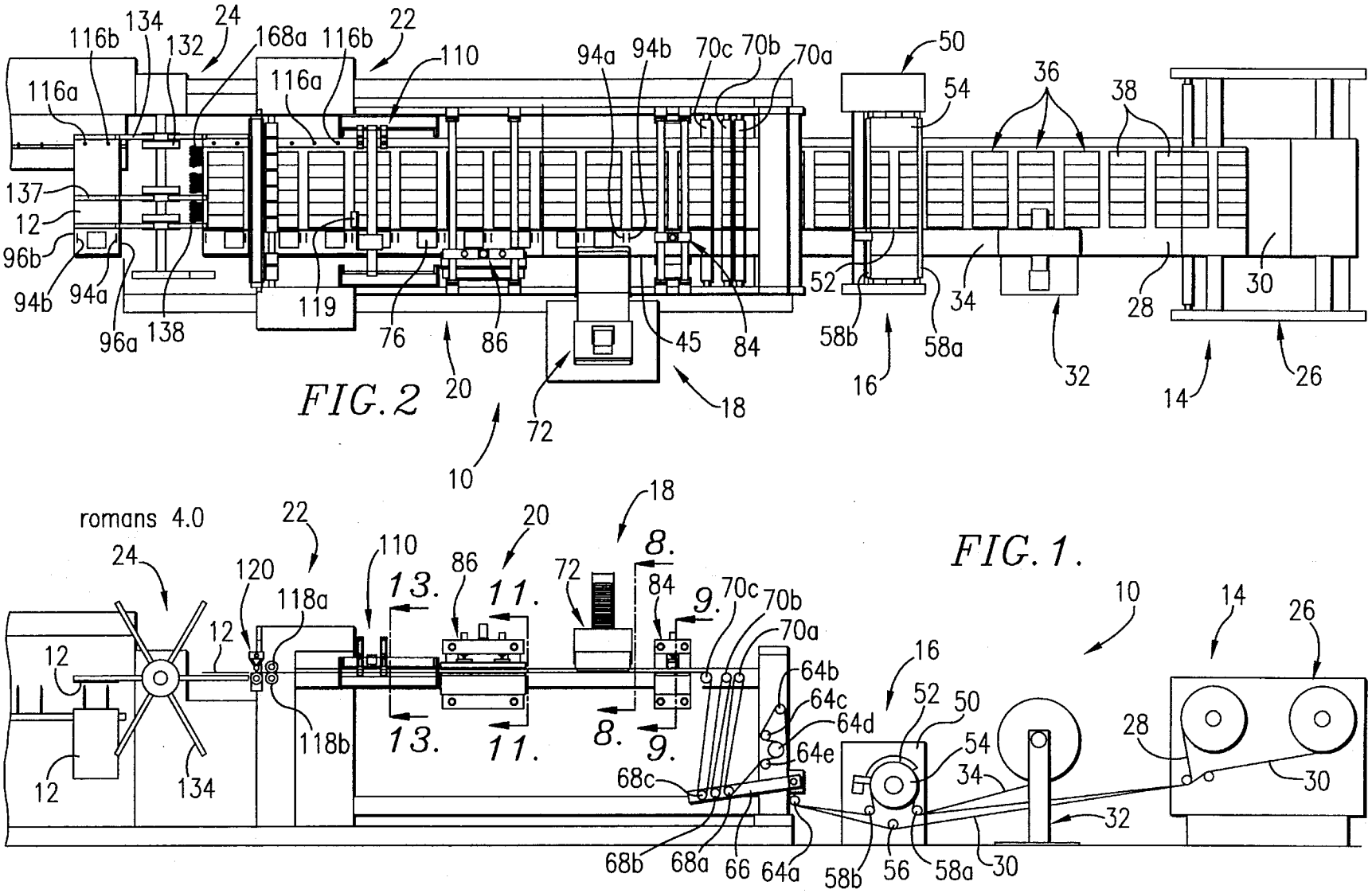
FIG. 1 is a rear elevational view in partial section of the preferred packaging apparatus of the present invention.
FIG. 2 is a plan view of the apparatus of FIG. 1.
Figures 3, 17:
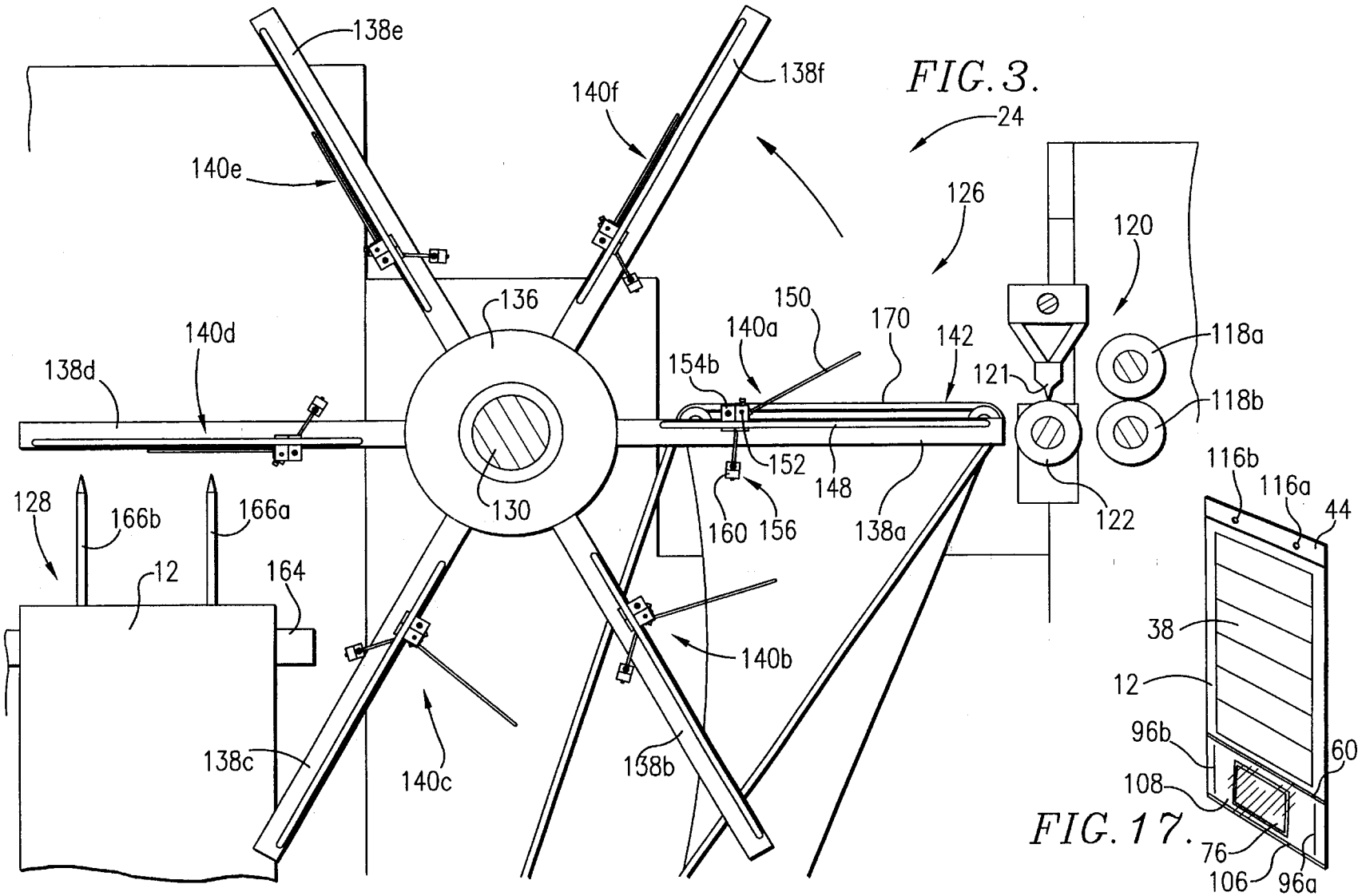
FIG. 3 is a partial elevational view of the discharge station of the apparatus of FIG. 1.
FIG. 17 is a perspective view of a completed bag produced by the apparatus of FIG. 1.

FIGS. 1 and 2 illustrate packaging apparatus 10 for producing a package such as bag 12 (FIG. 17). Apparatus 10 includes web dispensing station 14, pouch web connection station 16, article dispensing station 18, sealing station 20, cutting station 22, and discharge station 24. Web dispensing station 14 includes roll stand 26, for example, a Sheldahl Packaging Machinery Division LoBoy model unwind station, for continuously dispensing packaging web 28 and separate base web 30 superposed below web 28, and pouch roll stand 32 for continuously dispensing separate pouch web 34 onto packaging web 28 (FIG. 6). Webs 28, 30 and 34 are preferably composed of polyethylene although other synthetic resin webs may be used. It will be appreciated a package may be formed without the use of a base web resulting in an elongated packaging structure for handling encapsulated articles such as merchandise samples.

Packaging web 28 is preferably configured to present side-by-side, transverse, packaging sections configured as preferred bag sections 36 with each section including printing 38 thereon, and to present first side 40 and second side 42. As illustrated in FIGS. 6 and 7, all three webs are superposed and flush along one edge 45 thereof. Additionally, base web 30 is wider in order to present lip 44. Pouch web 34 presents first edge 46 and second edge 48 adjacent second side 42 of packaging web 28.

Pouch web connection station 16 includes hot air sealer 50 such as Model D 6094 by Atlanta Mesco of Marietta, Ga. having a hot air sealing arm 52, sealing drum 54, base web guide roller 56, and sealing guide rollers 58*a* and 58*b* which guide packaging and pouch webs 28, 34 between sealing arm 52 and drum 54 for sealing pouch web 34 to packaging web 28 at attachment zone 60 adjacent first edge 46 and spaced from second side 42. As a result, packaging web 28 and pouch web 34 present article-receiving pocket 62 therebetween which is open at the end of each bag section 36. Base web guide roller 56 guides base web 30 to bypass sealing drum 54 so that web 30 emerges from connection station 16 separate from the other two webs.

Article dispensing station 18 includes, for example, a modified Model #308 Sheldahl Packaging Machinery Division of Providence, R.I. table having guide rollers 64*a*, 64*b*, 64*c*, 64*d* and 64*e*, tension arm 66 having pivotal, tension rollers 68*a*, 68*b* and 68*c*, web rollers 70*a*, 70*b*, 70*c* and including an article dispenser 72. Similar tables by other manufacturers, e.g., Ro-An or FMC are similarly suitable. Guide rollers 64*a–e* receive and guide webs 28, 30 and 34 to tension rollers 68*a–c* and web rollers 70*a–c*. As illustrated in FIG. 1, webs 28, 30 and 34 are received around rollers 68*a–c* and 70*a–c* to provide sufficient web length during indexing of bag sections 36 through apparatus 10 while tension arm 66 maintains the proper tension on the webs and continues to feed for sealing unit 50 of station 16.

Figure 10:
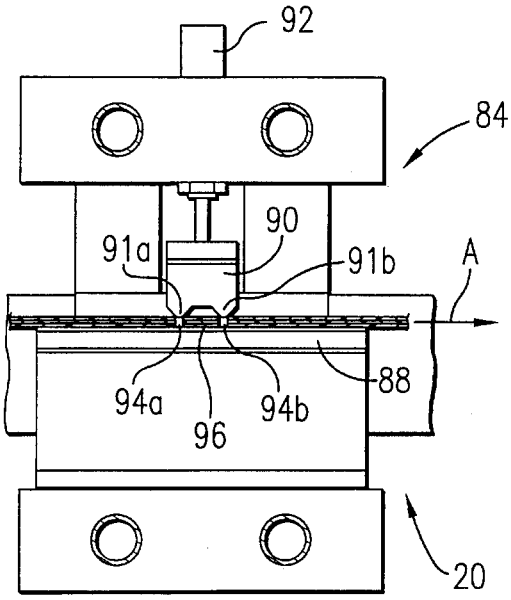
FIG. 10 is a schematic rear elevational view of the pouch sealer of FIG. 9 with the direction of web travel shown by the arrow A.
Figure 9:
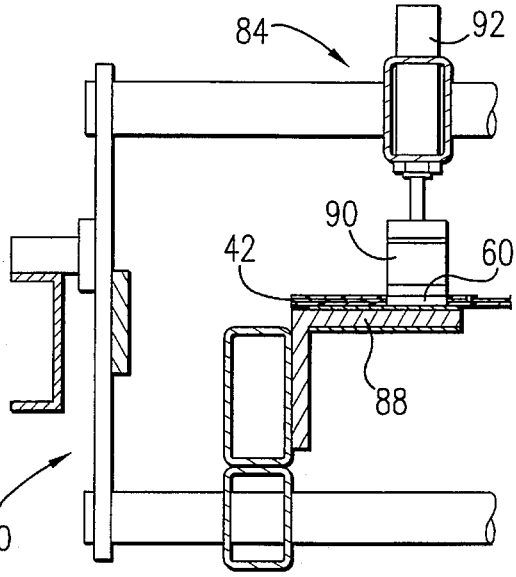
FIG. 9 is a schematic side elevational view of the pouch sealer taken along line 9—9 of FIG. 1.
Figure 11:
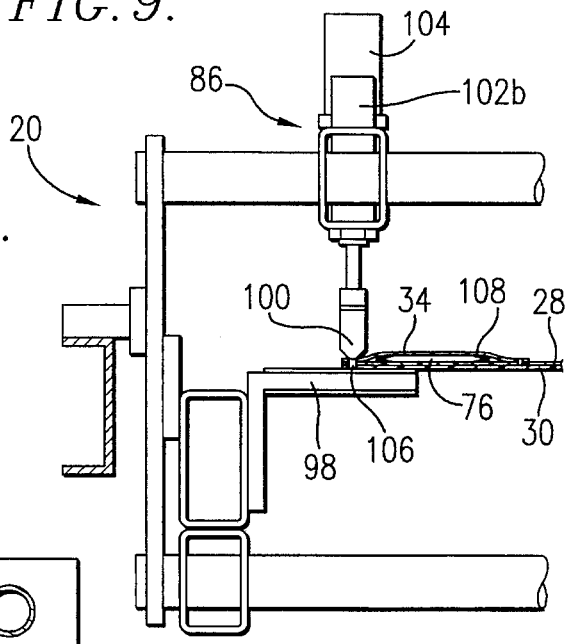
FIG. 11 is a schematic side elevational view of the end sealer taken along line 11—11 of FIG. 1.
Figure 12:
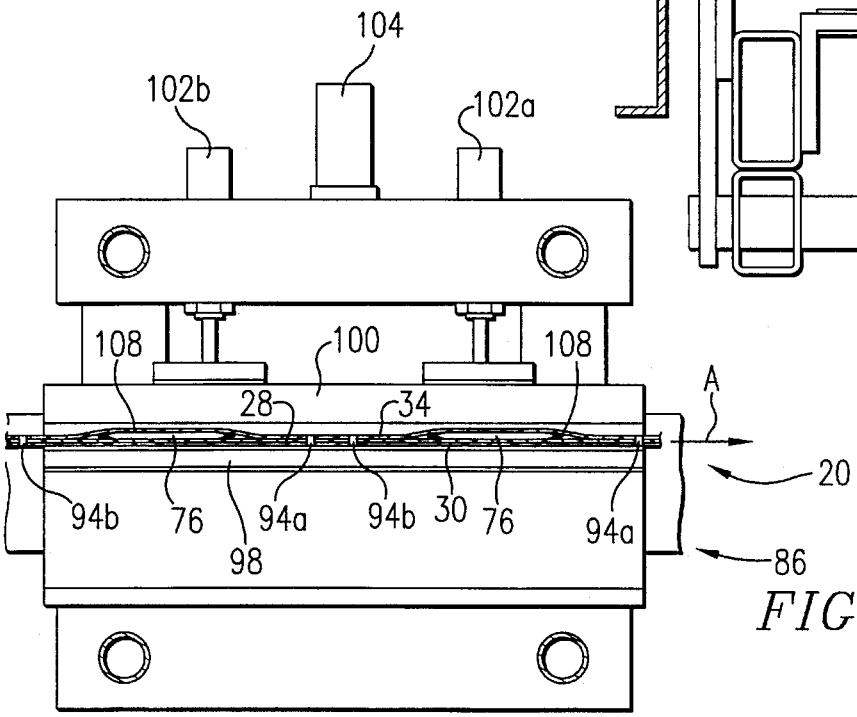
FIG. 12 is a schematic rear elevational view of the end sealer of FIG. 11 with the direction of web travel shown by the arrow A.

Webs 28, 30 and 34 advance to pouch sealer 84 (FIGS. 9 and 10) before proceeding to article dispenser 72 (FIG. 8) and end sealer 86 (FIGS. 11 and 12). Sealing station 20 includes the pouch sealer 84 and the end sealer 86. The pouch sealer 84 includes web support anvil 88 and a dual-tipped sealing element 90 presenting tips 91*a* and 91*b* vertically shiftable by solenoid-activated, air cylinder 92. Tips 91*a* and 91*b* of element 90 is positioned above, spaced longitudinally to the direction of web travel and oriented transverse to pouch web 34 in order to produce side seals 94*a* and 94*b* adjacent the attachment zone 60 and leaving the open end of pocket 62 for receipt of an article at article dispenser 72. Additionally, tips 91*a,b* are positioned to place seals 94*a,b* just within the respective side boundaries 96 of each bag section 36. At least one such seal 94*a* is provided at the upstream side of the bag section 36 to retain the article 76 to be received in the pocket 62, although two seals 94*a* and 94*b* are preferable. This limits the lateral shifting of an article 76 and prevents an article 76 from shifting outside the pocket 62. The use of adhesive on the surfaces defining pocket 62 is unnecessary and the article 76 is prevented from interfering with the cutting of packaging sections 36 along boundaries 96*a,b* without the need of adhesive on the surfaces defining pocket 62.

Turning now to FIG. 8, article dispenser 72 of article dispensing station 18 is preferably positioned intermediate pouch sealer 84 and end sealer 86. Article dispenser 72 may be, for example, by Langford Equipment International, Ltd. at Toronto, Canada which includes article stacker 74 shown supporting a plurality of articles 76 to be packaged, discharge body 78, chute 80 coupled with body 78, and a pair of pocket spreaders 82 extending from body 78. The distal end of chute 80 is received just inside pocket 62 adjacent packaging web 28 and spreaders 82 are received in pocket 62 above packaging web 28 in order to hold open pocket 62 for receiving an article therein as dispensed by way of chute 80. Alternatively, the sides of chute 80 may include upturned flanges to avoid the need for pocketspreaders 82. The article 76 is discharged down chute 80 at a sufficient velocity to reach attachment zone 60 but preferably not strike hard thereagainst so as to rebound toward second side 42. As the webs advance, inertia causes article 76 to slide against seal 94*a*. The articles 76 may include samples, literature, premiums or other material to be received in the pouch.

Webs 28, 30 and 34 next advance to end sealer 86 such as, for example, a Model #H216 270F by Park Air Corp. of Brockton, Mass. which includes anvil 98 and end sealing element 100 activated by air cylinders 102*a* and 102*b* which are, in turn, controlled by solenoid 104. When activated, end sealing element 100 creates end seal 106 positioned adjacent the three superposed edges of webs 28, 30 and 34. This closes pocket 62 in order to form pouches 108.

Figure 14:
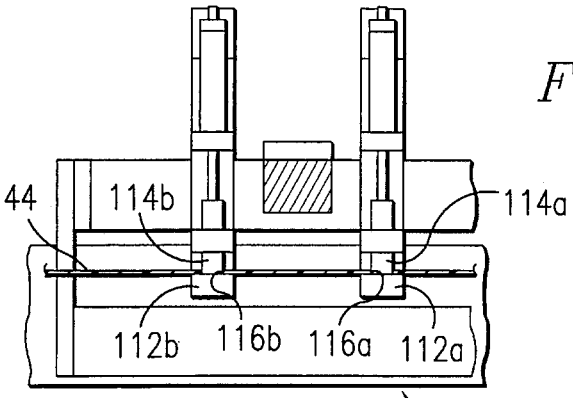
FIG. 14 is a rear elevational view of the hole punch of FIG. 13.
Figure 13:
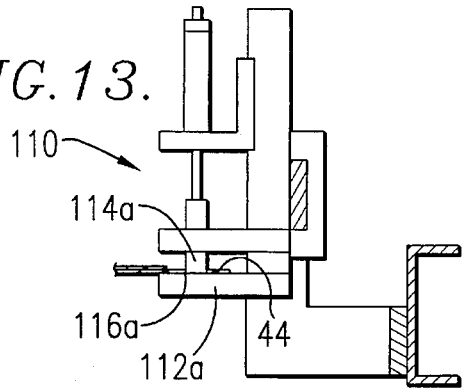
FIG. 13 is a side elevational view of the hole punch taken along line 13—13 of FIG. 1.
Figure 15:
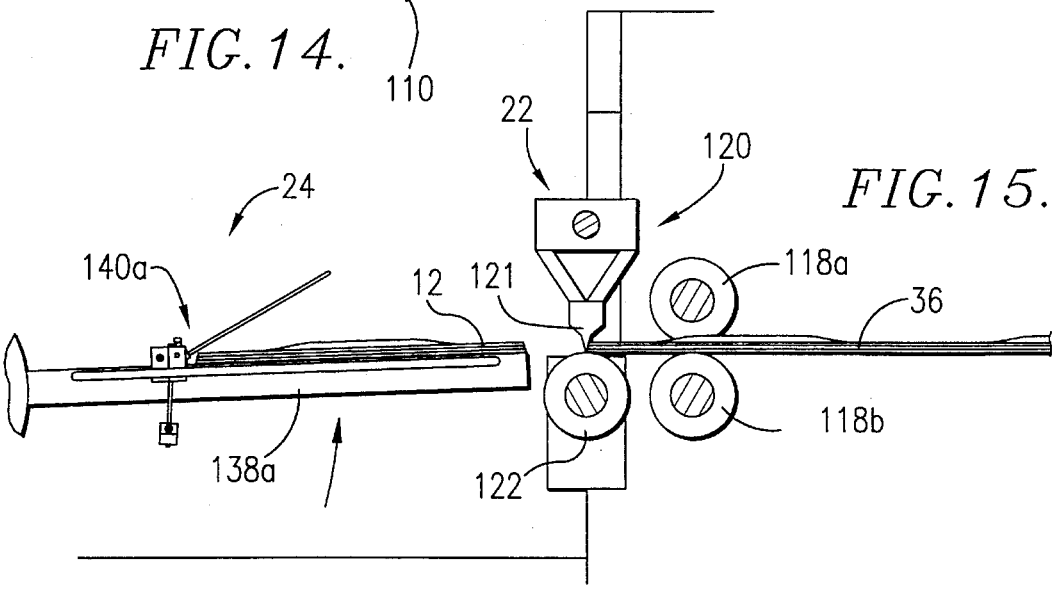
FIG. 15 is a partial sectional view of the cutting and discharge stations of the apparatus of FIG. 1 showing a bag receiving arm in the receiving position and a holding member in the open position.

After end sealing by station 20, cutting station 22 receives webs 28, 30 and 34. Station 22 includes hole punch 110 (FIGS. 13 and 14) having dies 112*a* and 112*b* with hole punch tools 114*a* and 114*b* in registration therewith. Tools 114*a,b* are operated by solenoid activated, air cylinders 116*a* and 116*b*. Hole punch 110 is positioned so that base web lip 44 is positioned between tools 114*a,b* and dies 112*a,b* in order to produce wicket holes 116*a* and 116*b* in lip 44 as best viewed in FIGS. 2 and 17.

Cutting station 22 also includes drive rolls 118*a,b* (FIGS. 2, 3, 15 and 16) positioned above and below webs 28, 30 and 34 and further includes a conventional indexing controller having web position sensor 119 such as a photoelectric eye, e.g., a Sick Model #NT6-03012 of Germany, operable to sense registration marks included as part of printing 38. The indexing controller operates drive rolls 118*a,b* to draw the webs through apparatus 10 so that bag sections 36 are indexed in succession through each of the operations performed by stations 18, 20, 22 and 24. The cutting station drive roller 118*a* is notched to allow passage of the article therebeneath. A conventional water jacket provided with circulating cooling water is positioned around the upper portion of the blade 120 to cool the latter and protect the drive rollers 118*a,b*.

Cutting station 22 further includes cutting assembly 120 having vertically shiftable cut-off blade 121 and anvil roller 122 with webs 28, 30 and 34 positioned therebetween. Blade 120 is heated and presents an impact radius of 1/64 to 3/32 inch. The cutting assembly is provided with a conventional water jacket which acts as a thermal radiator to protect the rolls 118 from excessive heat. The water jacket is positioned around the upper portion of the blade 120 to cool the latter and thereby protect the drive rollers 118*a,b*. During each indexing movement of webs 28, 30 and 34, bag section boundaries 94*a* and 94*b* are presented beneath blade 120 which shifts downwardly to pinch the webs against anvil roller 122. Under the pressure and heat of blade 120, boundary 94*a* is both sealed and cut. This seals the trailing bag boundary 94*b* of the previous bag section 36 and the leading bag boundary 94 of the next bag section 36.

Separation of bag sections 36 creates individual bags 12 formed between packaging web 28 and base web 30 (FIG. 17) and having an opening at the top adjacent lip 44 and of sufficient length to contain a folded newspaper between the opening and end seal 106. The bag 36 may be formed in different shapes or orientations as desired for receiving items other than newspapers. Article 76 is sealed within pouch 108 formed between pouch web 34 and packaging web 28. With this configuration, there is no excess web which has been a problem in the prior art. Furthermore, those skilled in the art will appreciate that the height of pouch 108 can be changed by changing the width of pouch web 34. This eliminates the need to carry differently sized packaging webs.

FIGS. 2–5 and 14–16 illustrate discharge station 24 which includes bag handling mechanism 126 and bag accumulator 128. Handling mechanism 126 includes axle 130, inboard vacuum hub 132 with six, evenly spaced, radially extending vacuum arms 134 coupled therewith. Mechanism 126 further includes outboard vacuum hub 136 with six, evenly spaced radially extending vacuum arms 138 shown in further detail as arms 138*a*, 138*b*, 138*c*, 138*d*, 138*e* and 138*f* coupled therewith, and six, bag holding assemblies 140 shown in further detail as assemblies 140*a*, 140*b*, 140*c*, 140*d*, 140*e* and 140*f* coupled respectively with arms 138*a–f*.

Additionally, mechanism 126 includes intermediate vacuum hub 135 with six, evenly spaced, radially extending vacuum arms 137 shown in further detail as 137*a*, 137*d*, 137*e* and 137*f*. Arms 134, 137 and 138 are in registration, that is, parallel to one another. Axle 130, hubs 132, 135 and 136 along with arms 134, 137 and 138 are hollow and present respective interior chambers in fluid communication and coupled with a conventional vacuum source (not shown) such as the vacuum pump. Furthermore, arms 134, 137 and 138 include a plurality of bag-holding, vacuum ports 144 (FIG. 4) defined in the respective bag-receiving faces 146 thereof. Mechanism 126 also includes bag conveyor 142.

Figure 4:
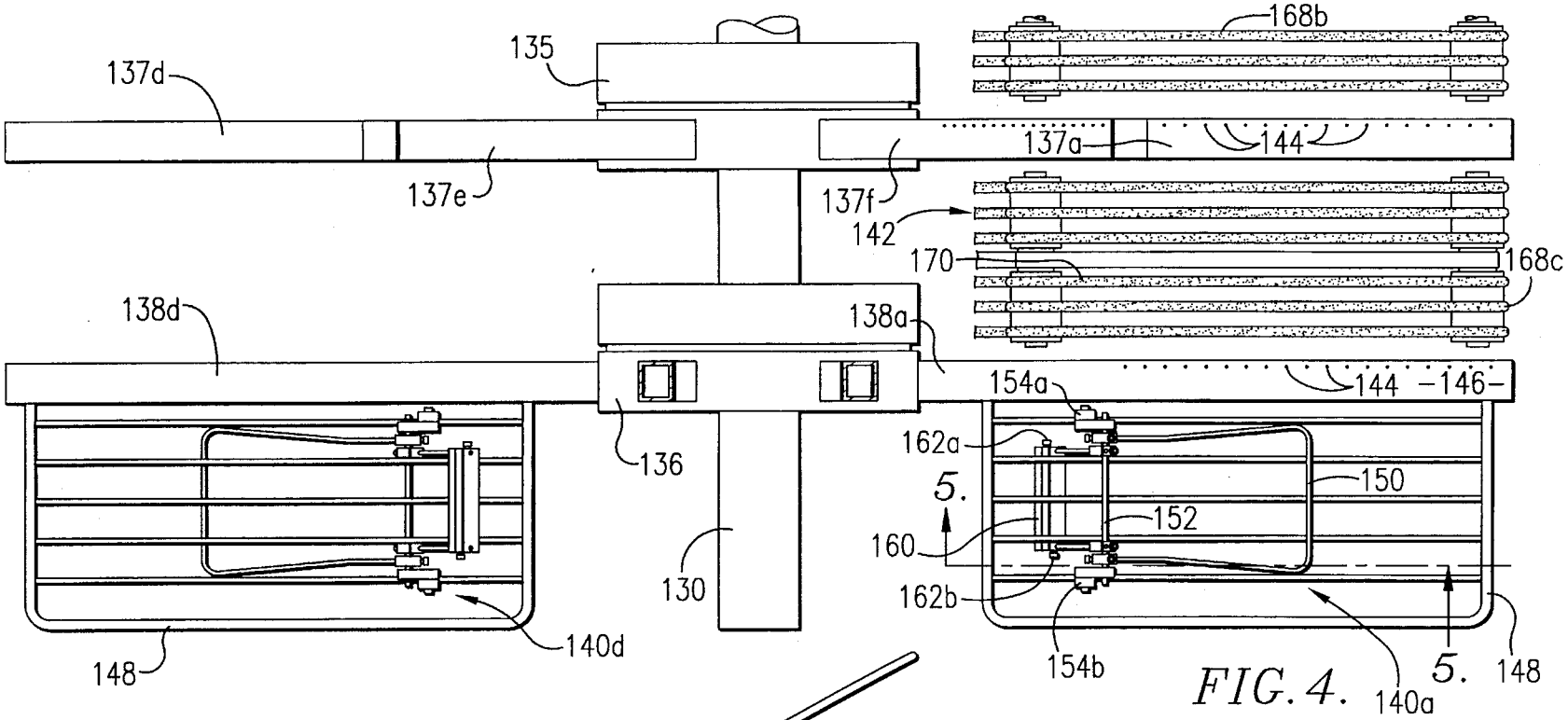
FIG. 4 is a partial plan view of the discharge station of the apparatus of FIG. 1.

Axle 130 rotates counter clockwise (as viewed in FIG. 3) in synchrony with the indexing of bags 12 leaving cutting station 22, and rotates arms 134, 137 and 138 along with holding assemblies 140 continuously through a plurality of positions. FIGS. 3–5 and 15 illustrate arms 137*a*, 138*a* and assembly 140*a* adjacent the discharge of station 24 and rotating through the bag receiving position. FIGS. 3–4 illustrate arms 137*d*, 138*d* and mechanism 140*d* adjacent accumulator 128 and rotating through the bag discharge position. FIG. 3 also illustrates the manner in which arms 134*b–c*, arms 137*b–c*, 138*b–c* and assemblies 140*b–c* rotate through transition positions, and the manner in which arms 134*e–f*, 137*e–f*, 138*e–f* and assemblies 140*e–f* rotate through bag holding positions.

Figure 5:
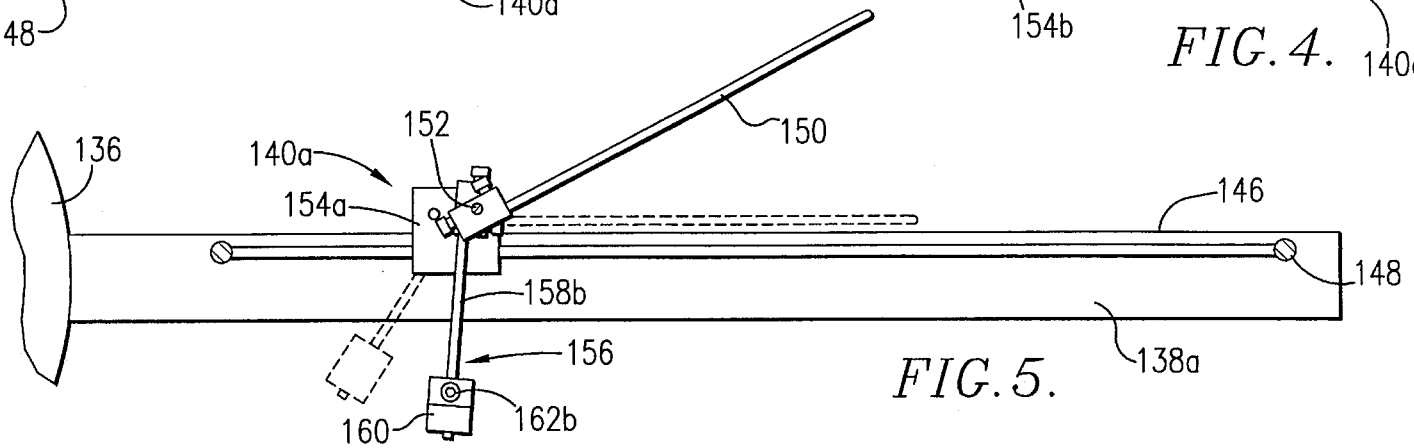
FIG. 5 is an elevational view of a bag handling structure arm of the discharge station of FIG. 4 showing the open position of the holding member, with the closed position shown in dashed lines.

As best viewed in FIGS. 4 and 5, holding assemblies 140*a–f* are coupled with the outboard sides of respective outboard vacuum arms 138*a–f*. Each assembly 140*a–f* includes wire frame 148 presenting a planar surface which extends bag-receiving face 146 of the associated vacuum arm 138*a–f*. Each assembly 140*a–f* also includes holding member 150 configured as a wire bail presenting a pair of ends intercoupled by pivot axle 152, a pair of pivot blocks 154*a* and 154*b* pivotally coupling the ends of pivot axle 152 with frame 148, and weight member 156. The pivotal connection between holding member 150 and frame 148 allows member 150 to shift between an open position spaced from receiving face 146 as illustrated in FIG. 5, and a closed position adjacent receiving face 146 as illustrated by the dashed lines in FIG. 5.

Pivot axle 152 couples weight member 156 with holding member 150. Weight member 156 extends from frame 148 on the opposed side of receiving face 146. Weight member 156 includes a pair of spaced, parallel, weight support rods 158*a* and 158*b*, weight body 160 slidably received on rods 158*a,b*, and set screws 162*a* and 162*b* threadably received through opposed ends of weight body 160 for engaging rods 158*a,b* respectively in order to adjustably position body 160 on rods 150*a,b*

Referring to FIG. 5, the length of rods 158*a,b* and the weight of body 160 together present a moment greater than the moment of holding member 150. Because of this, the moment of weight member 156 shifts holding member 150 to its open position as the respective holding assembly 140*a–f* moves toward and through the bag-receiving position. FIGS. 3 and 5 illustrate assembly 140*a* and vacuum arm 138*a* in the bag receiving position with associated holding member 150 in the open position due to the moment of weight member 156. With holding member 150 in the open position, a bag 12 may be received onto receiving faces 146 with that portion of the bag containing an article 76 positioned between holding member 150 and wire frame 148. Wire frame 148 provides additional support because of the article's weight.

As bag handling mechanism 126 rotates counter-clockwise, the moment of weight member 156 shifts holding member 150 to the closed position as illustrated in FIG. 3 for holding assemblies 140*e* and 140*f* passing through the holding positions. Mechanism 126 continues to rotate through the bag discharge position as illustrated by vacuum arm 138*d* and holding assembly 140*d*. Upon further rotation of mechanism 126, the holding assemblies move to the transition positions as illustrated by assemblies 140*c* and 140*b* in FIG. 3. In these positions, the moment of weight member 156 shifts the corresponding holding member 150 to the open position upon return to the bag receiving position.

As illustrated in FIG. 3, bag accumulator 128 includes block 164 presenting a pair of upstanding spikes 166*a* and 166*b*, positioned for registration with wicket holes 116*a,b* defined in bag lip 44 of a bag 12. Referring also to FIG. 2, during rotation of mechanism 126, lip 44 is supported by one of inboard vacuum arms 134*a–f* and supported so that wicket holes 116*a,b* are in registration with spikes 166*a,b*. As bag 12 rotates through the discharge position, spikes 166*a,b* are received in holes 116*a,b*.

As mechanism 126 rotates beyond the discharge position, bag 12 is pulled away from the supporting vacuum arms and holding assembly. Once released, bag 12 then hangs from spikes 166*a,b*. When a sufficient number of bags have been accumulated, the bundle is hot needled, wicketed or headered and then removed and prepared for shipment to the customer.

Figure 16:
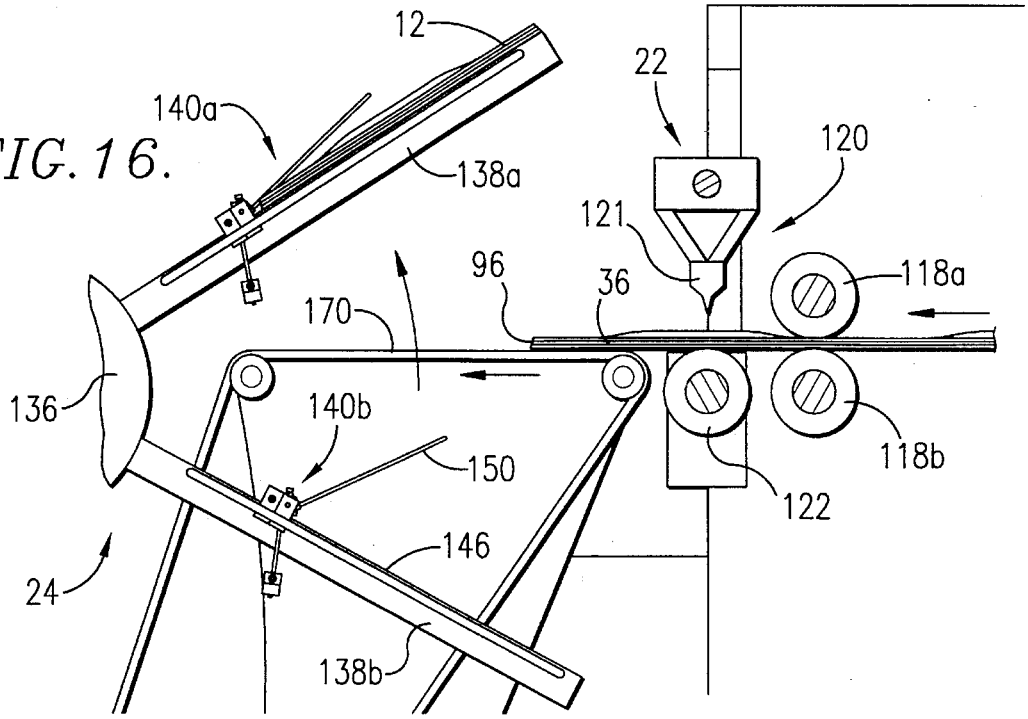
FIG. 16 illustrates the stations of FIG. 15 with the receiving arm located beyond the receiving position and the holding member shifted to the closed position.

FIGS. 2–4 and 15–16 illustrate bag conveyor 142 which includes conveyor sections 168*a* (FIG. 2), 168*b* and 168*c*, spaced to allow rotation of vacuum arms 134, 137 and 138 therebetween. Each conveyor section 168*a, b* and *c* is a conventional rope-type conveyor presenting a planar conveying surface 170 which is co-planar with the discharge of bags 12 from cut-off assembly 120, and positioned slightly above vacuum arms 134, 137 and 138 and wire frames 148 when these components are in the bag receiving position as illustrated in FIG. 16. The operation of mechanism 126 and bag conveyor 142 are synchronized with the discharge of bags 12 from cut-off assembly 120 so that bag conveyor 142 presents a completed bag 12 as a bag receiving surface 146 rotates through the receiving position. As mechanism 126 continues to rotate, surface 146 engages the lower side of the bag with pouch 108 positioned between member 150 (in the open position) and frame 148. As surface 146 rotates beyond the bag-receiving position, holding member 150 shifts to the closed position and vacuum ports 144 engage bag 12, which remains secured in this way through the transition and discharge positions as explained above.

Those skilled in the art will now appreciate that discharge station 24 handles bags 12 in an efficient manner in order to create a bundle ready for shipment to a customer. This has been a problem in the prior art because the upper part of the bag is flexible and light while the lower part of the bag containing the pouch and article therein are heavier and more rigid.

Those skilled in the art will also appreciate that the present invention encompasses many variations in the preferred embodiment described herein. In view of the detailed description of the preferred embodiment set forth herein, the following is claimed as new and desired to be secured by Letters Patent.

What is claimed is:

1. A packaging method for forming a wicket of elongated bags each secured to a common header and with an external, sealed pouch on each bag having an article therein, said method comprising the steps of:

providing a web set including an elongated continuous packaging web and an elongated continuous pouch web secured thereto, said packaging web presenting opposed inner and outer faces, opposed, laterally spaced apart first and second side margins, and a plurality of axially spaced apart article-receiving sections along the length of said outer face thereof, said pouch web presenting opposed internal and external faces and opposed, laterally spaced apart first and second edges, said pouch web being of a width less than the width of said packaging web, said pouch and packaging webs being in substantial axial alignment with the second edge of the pouch web adjacent the second side margin of said packaging web, said pouch web being secured to said packaging web along said first edge of the pouch web to define an axial line of connection along the length of the packaging web between said first and second side margins thereof, with said internal face of said pouch web being adjacent said outer face of said packaging web;

providing an elongated continuous backing web presenting opposed inboard and outboard faces and opposed, laterally spaced apart first and second side boundaries;

axially moving said web set and said backing web forwardly along a path of travel with said inboard face of said backing web being adjacent said inner face of said packaging web and with said second side boundary of said backing web adjacent said second side margin of said packaging web;

partially interconnecting said pouch web, packaging web and backing webs by forming successive partial heat seals between adjacent ones of said article-receiving sections, said partial heat seals being oriented transverse to the longitudinal axes of said webs and extending only a portion of the width of said pouch web leaving said second edge of the pouch web free of interconnection with said second side margin of said packaging web to thereby form a series of axially spaced apart partial pockets between said pouch web and said packaging web;

successively dispensing an article into each of said partial pockets, said transversely oriented partial heat seals serving to maintain said articles within said partial pockets and to inhibit lateral shifting of said articles beyond the corresponding partial pockets without the need for adhesive or the like;

fully interconnecting said pouch web, packaging web and backing web along transversely oriented full seal lines proximal to said partial heat seals, and Interconnecting said second side margins with said second edges and second side boundaries to define a plurality of completed elongated bags each presenting a sealed external pouch containing an article and an open end adjacent and between the first side margin of said packaging web and said first side boundary of the backing web, and separating said completed elongated bags; and joining said completed elongated bags to a common header adjacent the open ends thereof to form said wicket.

2. The method of claim 1, wherein said dispensing step comprises the steps of successively opening each of said partial pockets by separating the second edge of the pouch web from the second side margin of the packaging web, and inserting an article into each of said opened partial pockets.

3. Packaging apparatus comprising:

means including web dispensing and securing apparatus for forming a web set including an elongated continuous packaging web and an elongated continuous pouch web secured thereto, said packaging web presenting opposed inner and outer faces, opposed, laterally spaced apart first and second side margins, and a plurality of axially spaced apart article-receiving sections along the length of said outer face thereof.

said pouch web presenting opposed internal and external faces and opposed. laterally spaced apart first and second edges, said pouch web being or a width less than the width of said packaging web, said pouch and packaging webs being in substantial axial alignment with the second edge of the pouch web adjacent the second side margin of said packaging web, said pouch web being secured to said packaging web along said first edge of the pouch web to define an axial line of connection along the length of the packaging web between said first and second side margins thereof, with said internal face of said pouch web being adjacent said outer face of said packaging web;

web feeding means for providing an elongated continuous backing web presenting opposed inboard and outboard faces and opposed, laterally spaced apart first and second side boundaries;

web moving and guiding means for axially moving said web set and said backing web forwardly along a path of travel with said inboard face of said backing web being adjacent said inner face of said packaging web and with said second side boundary of said backing web adjacent said second side margin of said packaging web;

means for partially interconnecting said pouch web, packaging web and backing webs by forming successive partial heat seals between adjacent ones of said article-receiving sections, said partial heat seals being oriented transverse to the longitudinal axes of said webs and extending only a portion of the width of said pouch web leaving said second edge of the pouch web free of Interconnection with said second side margin of said packaging web to thereby form a series of axially spaced apart partial pockets between said pouch web and said packaging web;

article dispensing means for successively dispensing an article into each of said partial pockets, said transversely oriented partial heat seals sewing to maintain said articles within said partial pockets and to inhibit lateral shifting of said articles beyond corresponding partial pockets without the need for adhesive or the like;

interconnecting and separating means for fully interconnecting said pouch web, packaging web and backing web along transversely oriented full seal lines proximal to said partial heat seals, and interconnecting said second side margins with said second edges and second side boundaries to define a plurality of completed elongated bags each presenting a sealed external pouch containing an article and an open end adjacent and between the first side margin of said packaging web and said first side boundary region of the backing web, and separating said completed elongated bags; and wicket-forming means for joining said completed elongated bags to a common header adjacent the open ends thereof.

4. The apparatus of claim 3, wherein said dispensing means includes means for successively opening each of said partial pockets by separating the second edge of the pouch web from the second side margin of the packaging web, and means for inserting an article into each of said opened partial pockets.

* * * * *